US005984649A

United States Patent [19]

Kato et al.

[11] Patent Number: 5,984,649

[45] Date of Patent: Nov. 16, 1999

[54] AIR CURTAIN FAN WITH HEATING ELEMENTS

[75] Inventors: Yasuhiro Kato; Hisayuki Matsuzawa, both of Tokyo; Yutaka Ito, deceased, late of Tokyo, all of Japan, by Masao Ito, legal representative

[73] Assignee: Mitsubishi Denki Kabushiki Kaisha, Tokyo, Japan

[21] Appl. No.: 08/719,024

[22] Filed: Sep. 24, 1996

[30] Foreign Application Priority Data

Sep. 25, 1995 [JP] Japan ..... 7-246048

[51] Int. Cl.[6] ..... F04B 17/00; H05B 1/00; H05B 3/68

[52] U.S. Cl. ..... 417/423.5; 219/200; 219/467; 417/423.14

[58] Field of Search ..... 219/467, 200, 219/201, 370; 417/423.5, 423.7, 423.14, 313; 454/188, 190, 249, 251, 253; 98/36

[56] References Cited

U.S. PATENT DOCUMENTS

| | | | |
|---|---|---|---|
| 3,086,441 | 4/1963 | London | 98/36 |
| 3,797,373 | 3/1974 | Larson | 98/36 |
| 4,162,395 | 7/1979 | Kobayashi et al. | 219/367 |
| 4,737,616 | 4/1988 | Wen-Ying | 219/370 |
| 4,876,436 | 10/1989 | Ide et al. | 219/370 |
| 4,989,501 | 2/1991 | Catan | 98/36 |

FOREIGN PATENT DOCUMENTS

| | | |
|---|---|---|
| 0611924 | 8/1994 | European Pat. Off. . |
| A 6313603 | 11/1994 | Japan . |

*Primary Examiner*—Charles G. Freay
*Assistant Examiner*—Paul Ratcliff

[57] ABSTRACT

A fan comprises blowing units, each including a squarely hollow casing, an electric motor incorporated into the casing and an axial impeller coupled to the motor for generating an air flow from an inlet toward nozzles; the casing having one end opened to form the inlet and the opposite end opened to form the nozzles; and a guide which projects into the casing to arrange the nozzles in a parallel pattern, in a slit shape and in rows; wherein each blowing unit has opposite side walls of the casing formed with openings for mounting heaters at locations corresponding upstream portions of outlets of the parallel nozzles, and the blowing units are coupled together at adjacent sides thereof to be arranged in a row so that the units have corresponding openings located in alignment with one another throughout the entire coupled units.

15 Claims, 8 Drawing Sheets

AIR CURTAIN FAN WITH HEATING ELEMENTS

BACKGROUND OF THE INVENTION

1. Field of the Invention

The present invention pertains to the technical field of a fan for forming an air curtain at an opening of a building.

2. Discussion of Background

Such an air curtain is formed by cross flow fans with air flowing across impellers or axial fans. In case of using the axial fans, a structure which has been disclosed in e.g. JP-A-6313603 has been adopted. Specifically, as shown in FIG. 12 of the present application, axial fan units 101 which are respectively constructed to work as an independent fan are arranged in a row to provide a collective fan as a whole. Although it is difficult to modify the entire length of a collective fan in case of using the cross flow fans, the arrangement of the units 101 as just above mentioned allows the entire length to be easily modified by increasing or decreasing the number of the units 101 or adjusting spacing between the units 101.

The air curtain is discharged directly downward or downward at an angle with respect to the vertical direction as needed. The discharging direction of the air curtain is changed by adjusting the direction of outlets of the collective fan. In practice, changing the discharging direction is dealt with by adjusting a mounting angle of the collective fan to a building, or providing rotatable louvers at a downstream side of the collective fan, which is disclosed in the publication.

From the viewpoint that a person who passes through the air curtain in winter is exposed to fast cold air and feels extremely cold, some collective fans have a heater incorporated thereinto to heat the air. Cross flow fans have the same arrangement as a hot air heater adopted thereinto for heating, discharging a heated air curtain. Each guide 102 which is formed as a flow divider has a reflecting plate 103 and a heater 104 incorporated therein to irradiate heat downward even in the axial fan type of the publication as shown in FIG. 13, preventing a person from feeling cold.

The conventional collective fan with axial fans in a row as stated earlier creates some problems. One of them is that it is difficult to take measures to prevent a person from feeling cold. In order to obtain heated air in the arrangement shown in FIG. 13, each unit 101 has to be provided with means for generating heated air though an air curtain itself remains cold and coldness can not be modulated drastically. On the other hand, when the collective fan is installed at a door way and the like of a walk-in refrigerator, it is not necessary obtain heated air. Under the circumstances, it is disadvantageous in terms of cost and production to cope with those two contradictory purposes by providing two types of fans.

Another is that when the collective fan has a heater incorporated therein to obtain heated air, a heater supporting structure and its accessory parts are needed in addition to requirement of a heat-resistant structure, which can not meet the demands for a decrease in cost and companction. Because two rows of air flows are blown out, collective fans for industrial use which are operated by three-phase alternating current has difficulty in the number of heaters in terms of load balance of three-phase alternating current supply. It is difficult to equalize the temperatures of two rows of air curtains.

SUMMARY OF THE INVENTION

It is an object of the present invention to eliminate the disadvantages of the conventional collective fan and to provide a new and improved fan capable of easily modifying a fan with axially fans arranged therein into a fan to obtain heated air.

It is another object of the present invention to provide a new and an improved fan capable of modifying a fan with axial fan arranged therein into a fan to obtain heated air without difficulty to use three-phase alternating current supply.

It is a further object of the present invention to provide a new and an improved fan capable of modifying a fan with axial fan arranged therein into a fan to obtain a heated air by a simple structure at a minimized increase in cost.

According to a first embodiment of the invention, a fan comprises blowing units, each including a squarely hollow casing, an electric motor incorporated into the casing and an axial impeller coupled to the motor for generating an air flow from an inlet toward nozzles; the casing having one end opened to form the inlet and the opposite end opened to form the nozzles; and a guide which projects into the casing to arrange the nozzles in a parallel pattern, in a slit shape and in rows; wherein each blowing unit has opposite side walls of the casing formed with openings for mounting heaters at locations corresponding upstream portions of outlets of the parallel nozzles, and the blowing units are coupled together at adjacent sides thereof to be arranged in a row so that the units have corresponding openings located in alignment with one another throughout the entire coupled units.

According to a second embodiment of the invention, an equalizing plate which is made from a heat-resistant material is arranged in an intermediate portion of each parallel nozzle to be substantially in parallel with the side walls of the casing of each unit, and the equalizing plate has heater supporting structure arranged therein at locations in alignment with the openings formed in the side walls.

According to a third embodiment of the invention, a heater energizing circuit which is fed with a three-phase alternating current supply, each of the two rows of parallel nozzle array which are formed by coupling the units has two heater arranged therein, and the heater energizing circuit energizes the four heaters.

According to a fourth embodiment of the invention, the heaters are constituted by bar-like sheathe heaters which extend in each nozzle array therealong, and the heaters in each nozzle array are arranged one above the other.

According to a fifth embodiment of the invention, the heaters are constituted by bar-like sheathe heaters which extend in each nozzle array therealong, and the heaters in each nozzle array are arranged side by side.

According to a sixth embodiment of the invention, a fan comprises blowing units, each including a squarely hollow casing, an electric motor incorporated into the casing and an axial impeller coupled to the motor for generating an air flow from an inlet toward nozzles; the casing having one end opened to form the inlet and the opposite end opened to form the nozzles; and a guide which projects into the casing to arrange the nozzles in a parallel pattern, in a slit shape and in rows; wherein the blowing units are coupled together at adjacent sides thereof to be arranged in a row, and each nozzle has a heating element arranged therein so that the heating element can contact with an air flow passing through the nozzle.

According to a seventh embodiment of the invention, the heating element comprises a planar heating element which is formed at the guide.

According to a eighth embodiment of the invention, the heating element is a heater arranged in each nozzle array, the heater having a function to change a discharging direction of the passing air flow as a louver.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Now, the present invention will be described in detail in reference to embodiments shown in the accompanying drawings.

Embodiment 1

Figure 1:
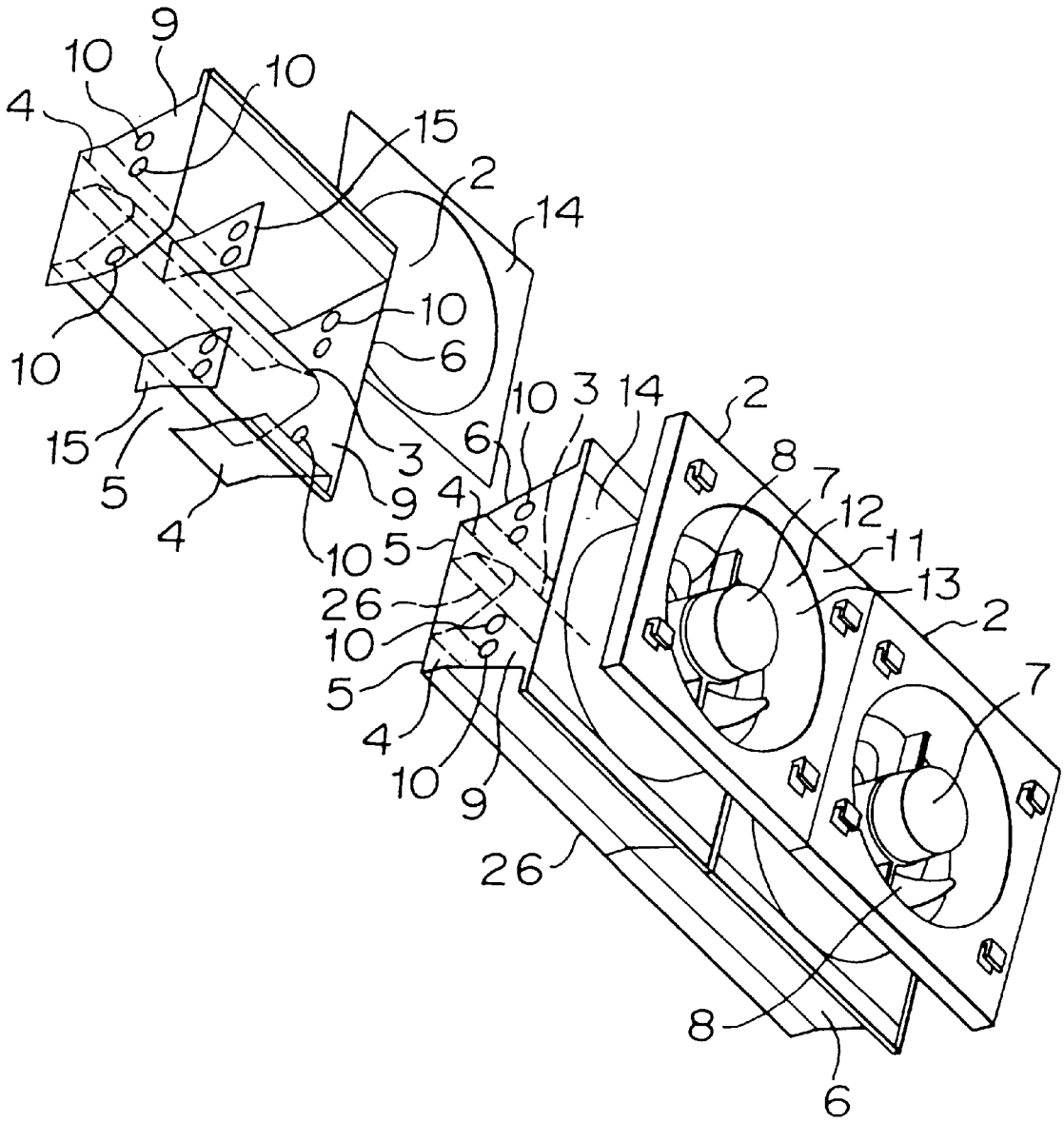
FIG. 1 is an exploded perspective view of the fan according to a first embodiment of the present invention, portions of the fan being omitted.
Figure 2:
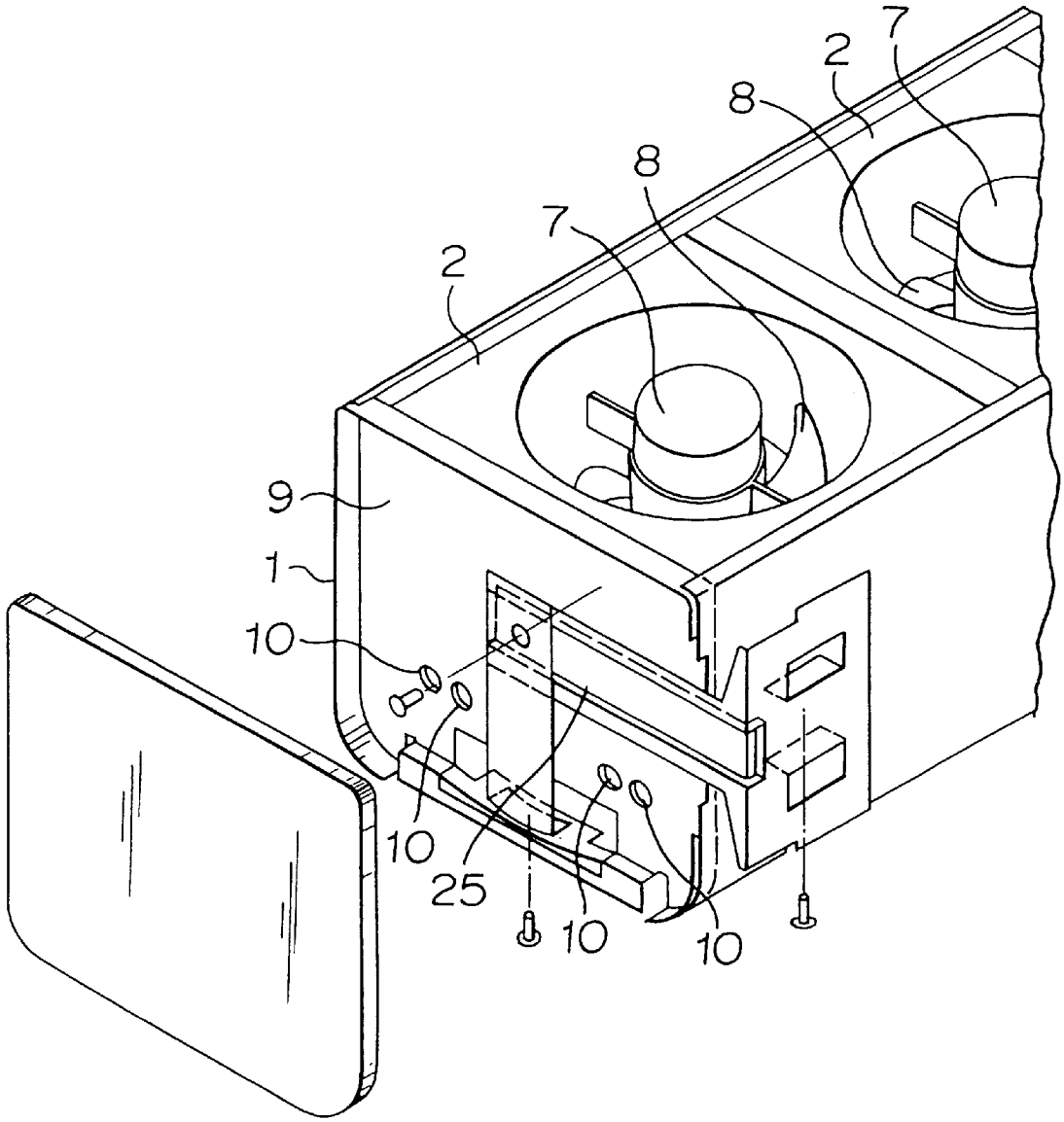
FIG. 2 is an exploded perspective view of the structure of the main portion of the fan according to the first embodiment.
Figure 3:
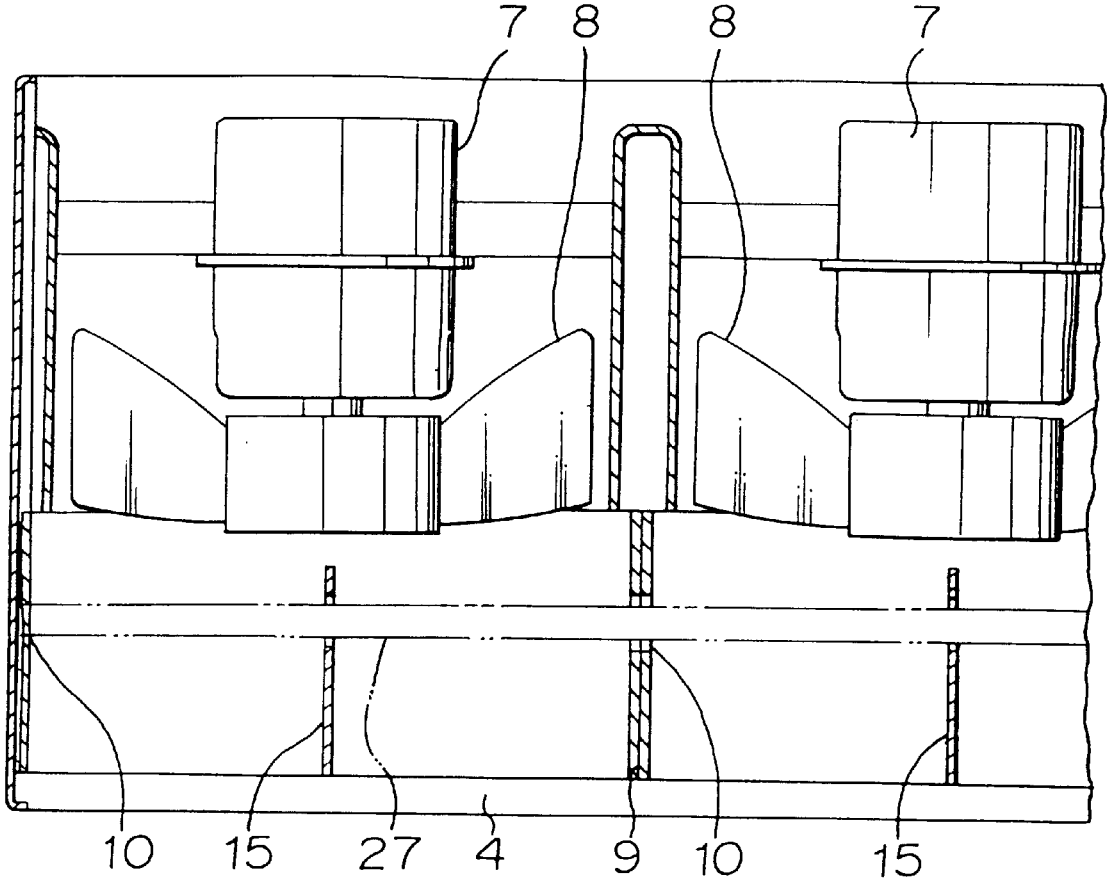
FIG. 3 is an enlarged sectional view of a portion of the fan according to the first embodiment as viewed in the longitudinal direction.
Figure 4:
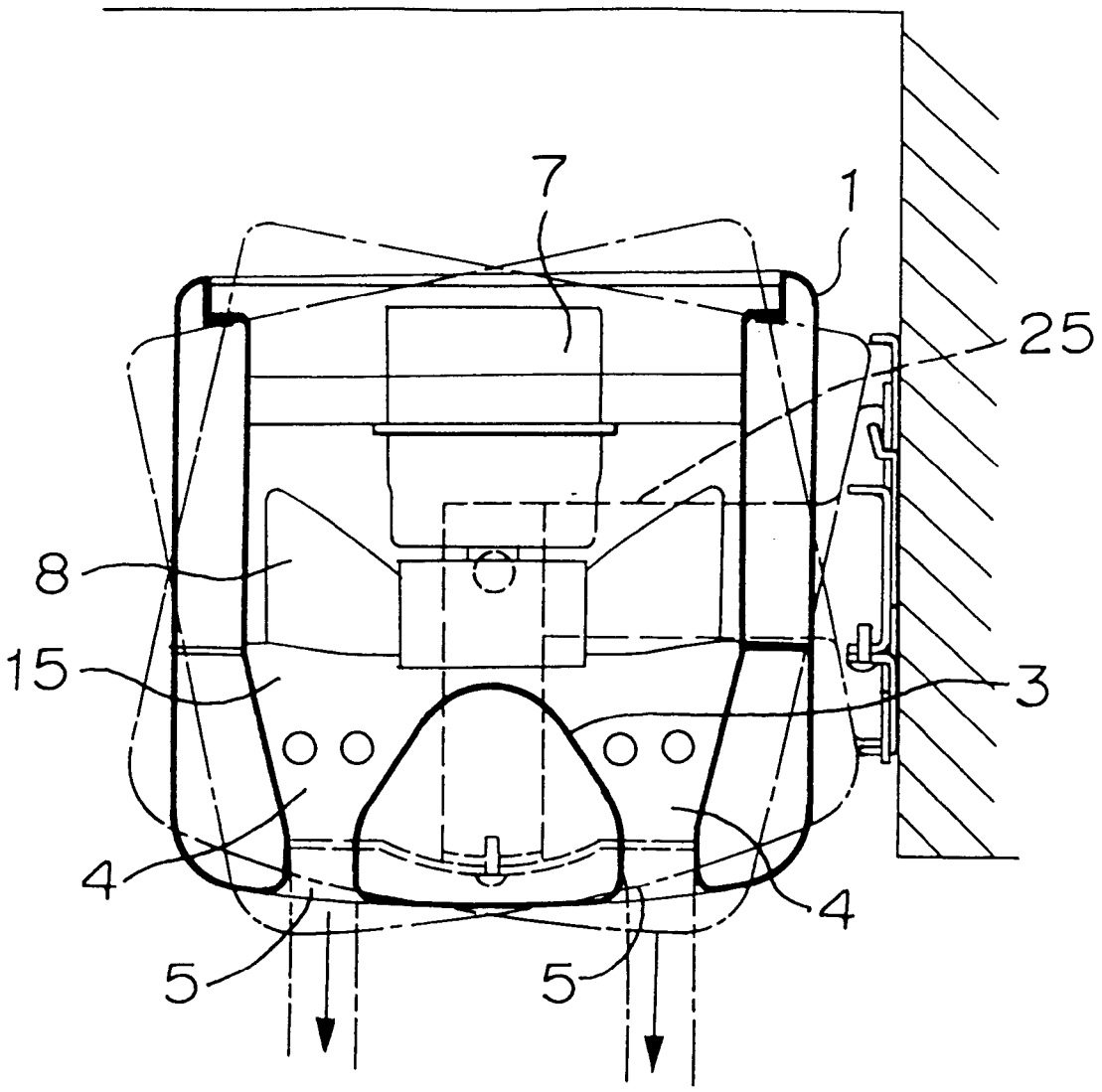
FIG. 4 is an enlarged sectional view of the fan according to the first embodiment as viewed in the width direction.

In FIG. 1, there is shown an exploded perspective view of the fan according to a first embodiment of the present invention, portions of the fan being omitted. In FIG. 2, there is shown an exploded perspective view of a portion of the fan. In FIG. 3, there is shown an enlarged sectional view of a portion of the fan in the longitudinal direction. In FIG. 4, there is shown an enlarged sectional view of the fan in the width direction. The fan has a plurality of blowing units laterally arranged in a row in a housing 1 which is formed in an elongated frame body with upper and lower ends opened. The housing 1 is made of sheet metal. The housing has stepped receivers provided therein at a forward end and a rear end of the upper opened portion, and the lower opened portion is formed by inwardly bent portions at the front and rear ends to be narrower than the upper opened portion as shown in FIG. 4. Free ends of the inwardly bent portions at the front and rear ends project into the housing upward. The housing 1 may have a dividable structure wherein a combination of an elongated hole and a bolt (not shown) which are provided in overlapping portions can adjust the entire length of the fan within a range defined by the length of the elongated hole.

The respective blowing units 2 are all formed in the same shape and the same size. Specifically, each blowing unit 2 has such a structure that an electric motor 7 driven in three-phase alternating current and an axial impeller 8 thereon are incorporated into a squarely hollow metallic casing 6 which has an upper end opened as a square inlet and a lower end opened downward as outlets 5 in a form of slit-shaped parallel nozzles 4, the nozzles being formed in rows at the front and rear sides on the lower end by providing an angled guide 3 projecting into the casing, as shown in FIGS. 1 and 2. The casing 6 has stepped portions formed at upper front and upper rear positions therein to be received and supported by the stepped receivers of the housing 1, and has engaged portions (not shown) formed at a lower portion therein to be engaged with free ends of the bent portions at the front and rear sides of the housing 1 from upwardly. The guide 3 in each casing 6 continuously extends at the lower portion of the casing 6 in the horizontal direction, and the guide works to branch an air flow path in the casing 6 into flows directed into the parallel nozzles 4 by means of slanted surfaces of the guide. Each casing 6 has opposed side walls 9, which respectively have two round holes 10 as heater mounting openings formed therein at a position corresponding to an upstream portion of the outlet 5 of each parallel nozzle 4. The opposed paired round holes which are formed in the opposed side walls 9 for the respective parallel nozzle 4 are arranged in alignment with each other.

To the inlet of each casing 6 is mounted a metallic inlet part as a lid by fitting, which includes an upper square and flat flange 11 with a bellmouth 12 integrally formed at a central portion thereof. The bellmouth 12 of the inlet part forms a substantially circular inlet 13 and the upper flange 11 has an upper surface integrally formed at suitable positions with projections for mounting a guard in a detachable manner. The bellmouth 12 itself extends in a cylindrical shape to project into the casing 6 so as to surround an outer periphery of the axial impeller 8 mounted to the motor 7. To an outer periphery of the outlet side of the bellmouth 12 is fitted a thin, square and flat metallic closure plate 14 which is slightly smaller than the upper flange 11. The closure plate 14 has outer end surfaces gotten in close contact with an inner surface of the casing 6 by mounting the inlet part to the casing 6, and a space which is formed between the outer periphery of the bellmouth 12 and the inner surfaces of the casing 6 is closed by the closure plate 14 and the upper flange 11 in each casing. In each casing 6, equalizing plates 15 are arranged at an intermediate portion of the guide 3 to extend between the guide 3 and an inner wall at the front end and between the guide 3 and an inner wall at the rear end.

Figure 5:
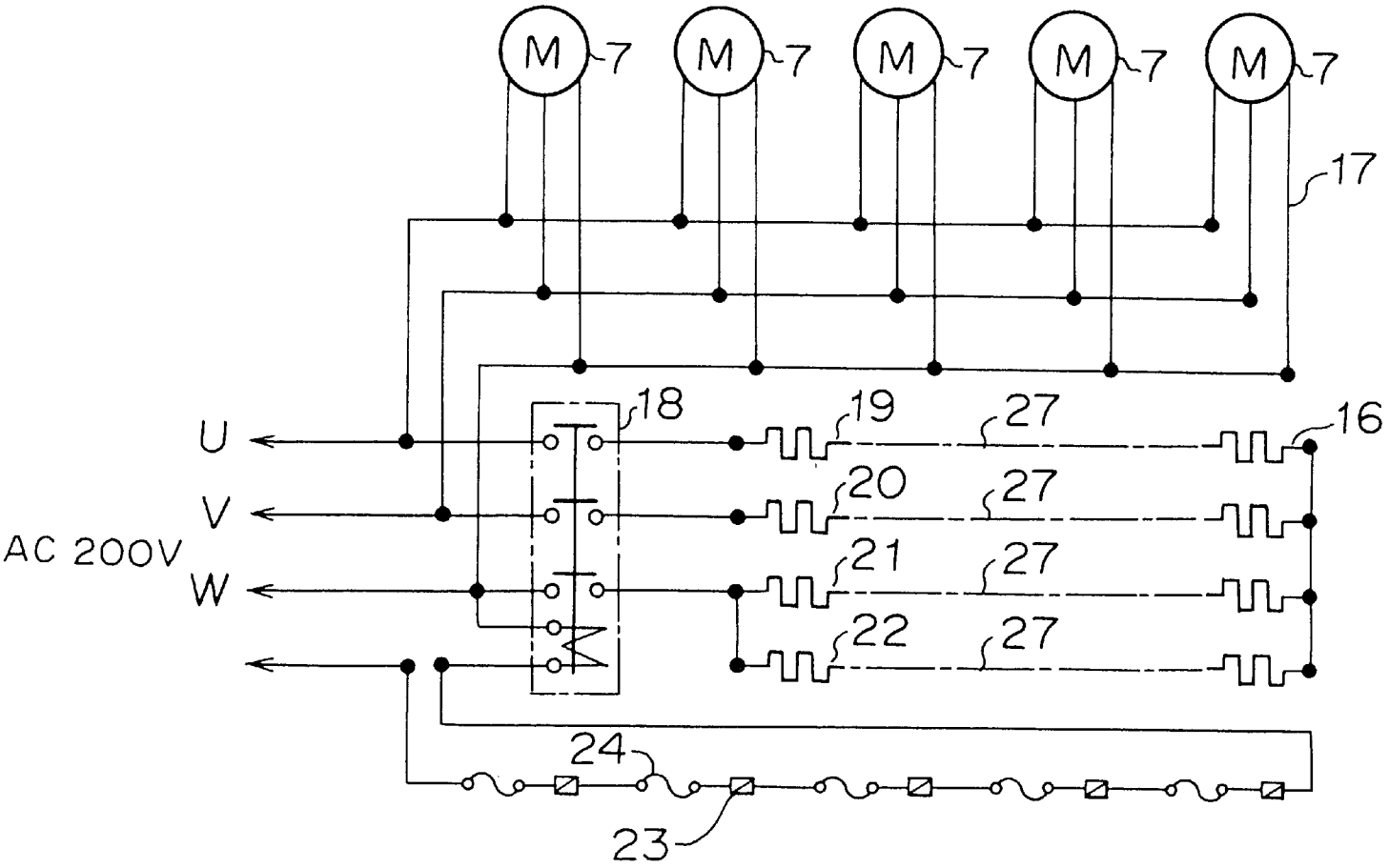
FIG. 5 is an electrical circuit diagram of the fan according to the first embodiment.

The fan includes the housing and a plurality of the blowing units 2 arranged in a row in the housing 1, and the entire length of the fan can be adjusted by an easy operation such as adjustment of spacing between adjoining blowing units 2. The guides 3 in the respective blowing units 2 are continuous one another, and have electrical equipment such as a capacitor and a terminal board, and wiring as shown in FIG. 5 collectively arranged therein. The wiring by includes a heater energizing circuit 16 and a motor energizing circuit 17 which are provided power from a three-phase alternating current supply. The motor energizing circuit 17 has an arrangement in which the respective motors 7 are connected in parallel with three single-phase alternating current supplies U, V and W. The heater energizing circuit 16 includes a first heat circuit 19 and a second heater circuit 20 fed from the respective single-phase alternating current supplies U, V through a circuit breaker 18 such as a relay, and a third heater circuit 21 and a fourth heater circuit 22 connected in parallel and fed from the remaining single-phase alternating current supply W through the circuit breaker 18. The first to fourth heater circuits are connected in parallel with the motor energizing circuit 17 through the circuit breaker 18. In FIG. 5, reference numeral 23 designates a thermostat, and reference numeral 24 designates a thermal fuse.

Mounting the fan can be carried out by mounting metal fittings to two positions of an upper portion of an opening of a building, hooking engagement portions of supporting arms 25 over engagement pieces provided on the metal fittings and bolting the engagement portions and the engagement pieces together as shown in FIG. 4.

Figure 6:
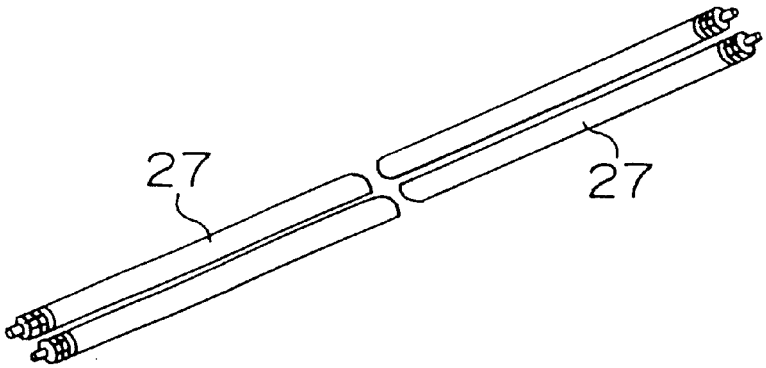
FIG. 6 is a perspective view of a sheathe heater usable in the fan according to the first embodiment.

In the fan according to the present invention, the respective parallel nozzles 4 in each blowing unit 2 form two rows of parallel nozzle array 26 as a whole to discharge two rows of air flows forming an air curtain. It is possible to easily give a heating function to the fan so as to make the air curtain hot. In detail, the respective groups of four holes which are formed in the respective opposite side walls of each blowing unit 2 are in alignment with each other one by one. Four bar-like sheathe heaters 27 as shown in FIG. 6 are inserted into the respective groups of four holes so as to run from one of the groups to the other, being arranged in parallel with each other. Each sheathe heater 27 has both ends connected to the heater energizing circuit 16 outside the outer side walls of the casings 6 of the outermost blowing units 2, forming the first, second, third and fourth heater circuits 19, 20, 21 and 22. The first and third heater circuits 19 and 21 are arranged in one of the rows in the parallel nozzle array 26, and the second and fourth heater circuits 20 and 22 are arranged in the other row. In that manner, the three-phase alternating current supply is balanced in terms of load, and the respective parallel nozzle array 26 can discharge hot air at an equalized temperature to form a hot air curtain which is free from discomfort due to unequal temperature distribution.

Figure 7:
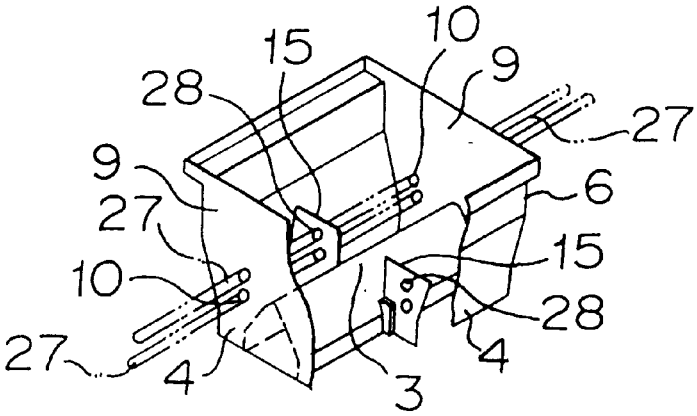
FIG. 7 is a perspective view of a portion of the fan in a modified form according to the first embodiment.

The paired holes 10 in each hole group in each parallel nozzle 4 are arranged side by side in the first embodiment to establish such a state that the sheathe heater 27 traverse the related air flow path. As a result, each air flow can collide against the related sheathe heaters 27 to obtain heat transfer effectively. The holes may be arranged one above the other as shown in FIG. 7 (The heaters are indicated by chain-dotted lines). In this case, pressure loss in the air flow can be minimized at the sheathe heater 27. Adoption of an arrangement intermediate between both arrangements may have a good relationship between heat transfer and pressure loss. The sheathe heaters 27 are relatively long. Absence of a supporting structure for the sheathe heaters introduces the danger of the sheathe heaters being vibrated due to collision with the air flow created by the axial impeller 8 to become unstable and be broken. In accordance with the first embodiment, the sheathe heaters 27 are highly stable without arranging a special supporting structure because the side walls 9 of the casing 6 in each blowing unit 2 support the sheathe heaters 27 at a short distance. The arrangement according to the first embodiment allows the sheathe heaters 27 to be supported without arrangement of an extra supporting structure, and the air curtain to be warmed with a sample structure, minimizing an increase in cost. If it is not necessary to make the air curtain warm, the holes 10 are closed by grommets or other members which can be readily detachable.

Figure 8:
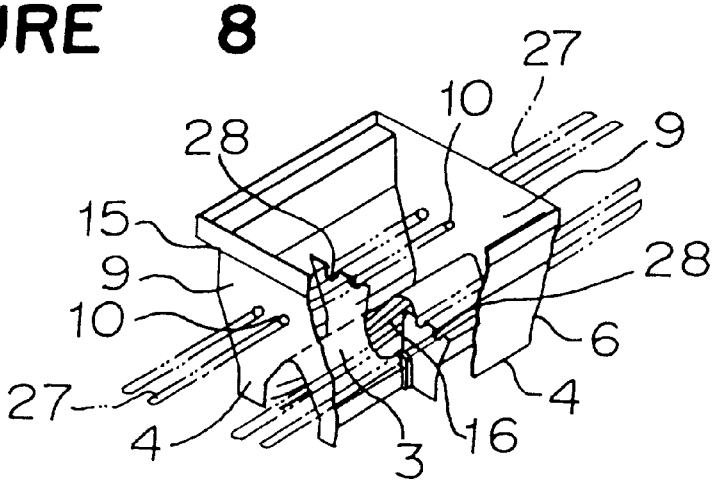
FIG. 8 is a perspective view of a portion of the fan in another modified form according to the first embodiment.

Although in the first embodiment explanation has been made for the case of using a three-phase alternating current supply, it is easy to modify the first embodiment so as to use ordinary household power. In this case, the special connection in the heater energizing circuit 16 as stated above is not necessary. If it is necessary to further improve the stability of the sheathe heaters 27, each blowing unit has the respective equalizing plates 15 formed at an upper portion with holes or recesses to provide heater supporting structures 28 as shown in FIG. 8 with the heaters indicated by chain-dotted lines, shortening the supporting distance for the sheathe heaters 27 and further enhancing the stability of the sheathe heaters 27.

Embodiment 2

Figure 9:
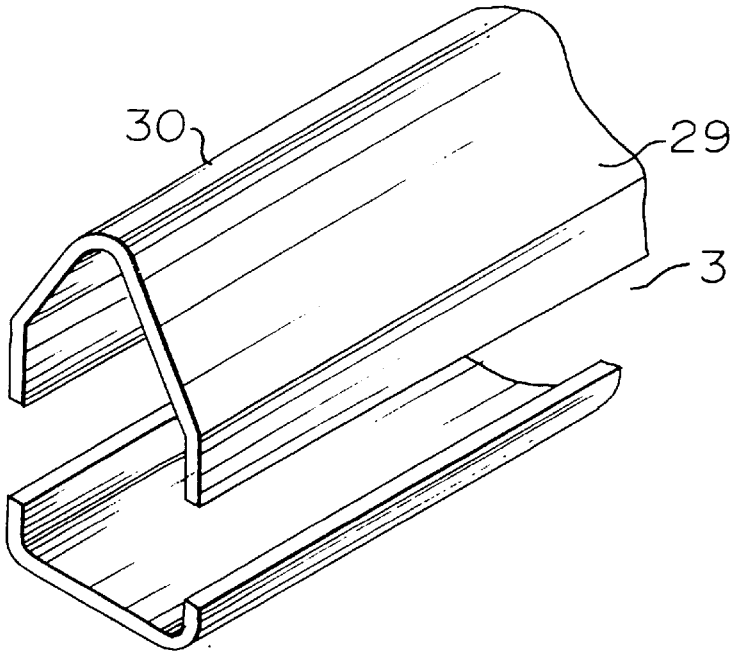
FIG. 9 is an enlarged perspective view of a guide in the fan according to a second embodiment of the invention.

In accordance with a second embodiment of the present invention, the fan described and shown as the first embodiment is modified so that portions of the parallel nozzles 4 in each blowing unit 2 which contact with the air flow are constituted by a heating element developing heat due to energization as shown in FIG. 9. Other parts than those required to have a function to obtain heated air are the same as the first embodiment. Identical or similar parts are indicated by the same reference numerals as the first embodiment, and explanation about those parts is omitted for simplicity.

In the second embodiment, the guide 3 has an upper angled portion 29 constituted by a planar heating element 30 as shown in FIG. 9 so as to develop heat due to energization. Such a planar heating element 30 may be prepared by incorporating a heating wire in an aluminum plate, incorporating a sheathe heater 27 in an aluminum substrate by die casting or spreading out a flexible planar heating element on a steel sheet and the like.

Although in the example shown, the angled portion of the guide 3 in each blowing unit 2 is constituted by the planar heating element 30, the respective guides 3 may be constituted by a single planar heating element 30 in the entirety of the fan. Other parts are the same as those of the first embodiment.

In accordance with the second embodiment, no increase in the number of required parts is introduced. Making the air curtain warm is possible without increasing pressure loss because the guides 3 which have their original purpose as air flow dividers develop heat. An increase in cost can be minimized. Similar function and similar advantage can be also obtained even if portions of the parallel nozzles 4 except for the guides 3 are constituted by similar planar heating elements 30. The other functions are the same as of those of the first embodiment, and explanation on these functions is omitted.

Embodiment 3

Figure 10:
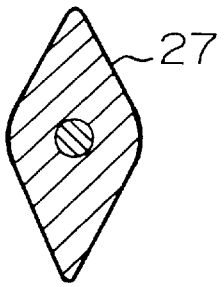
FIG. 10 is an enlarged sectional view of the sheathe heater according to a third embodiment.

In accordance with a third embodiment, in the fan described and shown with respect to the first embodiment, the sheathe heaters 27 also have a function to change the direction of air flow as louvers for changing the direction of passing air flow as shown in FIG. 10. Other parts than parts required for obtaining such a function are the same as those of the first embodiment. Identical or similar parts are indicated by the same reference numerals as the first embodiment, and explanation about those parts is omitted for simplicity.

Figure 11:
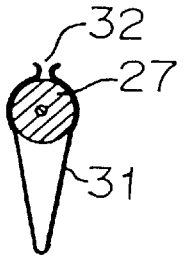
FIG. 11 is an enlarged sectional view of the sheathe heater in a modified form according to the third embodiment.
Figure 12:
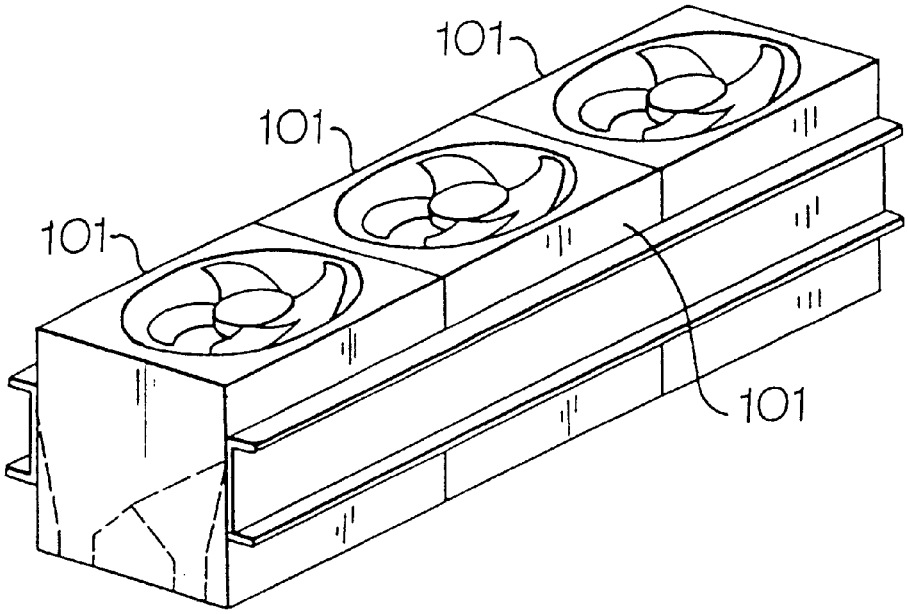
FIGURE 12 (CONVENTIONAL ART)
FIG. 12 is a perspective view of a conventional fan.
Figure 13:
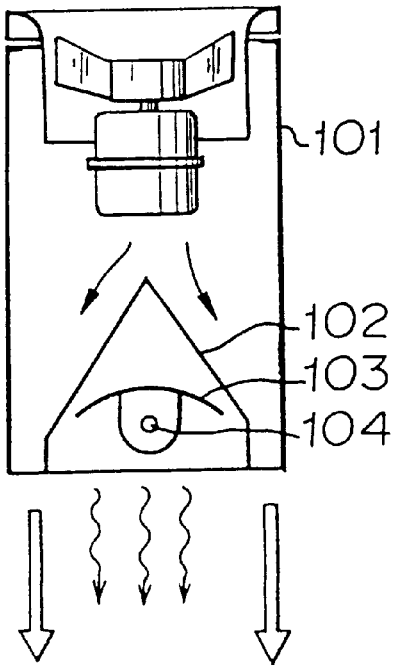
FIGURE 13 (CONVENTIONAL ART)
FIG. 13 is a sectional view of the conventional fan.

Specifically, in the third embodiment, the sheathe heaters 27 themselves are formed in a bar-like shape to have a rhombus cross section as shown in FIG. 10 so as to have a shape similar to an ordinary louver, or the sheathe heaters 27 are covered by auxiliary parts 31 with a louver function as shown in FIG. 11 so as to have a shape similar to an ordinary louver. The sheathe heaters 27 are supported so as to be rotatable. In practice, the respective auxiliary parts 31 can be made of an elastic material and attached to the respective sheathe heaters 27 through openings 32 thereof using elastic deformation to facilitate assemblage in a convenient manner. By such an arrangement, the direction of the air curtain discharged from the parallel nozzles 4 can be changed using the function of the sheathe heaters 27 as louvers, improving the function of the fan by at least sufficient number of parts. The other basic functions are the same as those of the first embodiment, and explanation on those functions is omitted for simplicity.

Obviously, numerous modifications and variations of the present invention are possible in light of the above teachings. It is therefore to be understood that within the scope of the appended claims, the invention may be practiced otherwise than as specifically described herein.

What is claimed is:

1. A fan comprising:

plural blowing units, each including a relatively square hollow casing, an electric motor mounted in the casing and an axial impeller coupled to the motor for generating an air flow from an inlet toward one or more outlet nozzles;

the casing having one end opened to form the inlet and the opposite end opened to form the outlet nozzles; and a guide which projects into the casing to arrange the nozzles in a parallel pattern, in a slit shape and in rows;

each blowing unit having a pair of opposite side walls of the casing formed with heater receiving openings at locations corresponding to upstream portions of outlets of the parallel nozzles, the blowing units being coupled together along the pair of opposite sides thereof and arranged in a row so that the units have corresponding heater receiving openings located in alignment with one another throughout the coupled plural blowing units; and a heater extending through the corresponding heater receiving openings in the row of the plural blowing units.

2. A fan according to claim 1, further comprising an equalizing plate which is made form a heat-resistant material is arranged in an intermediate portion of each parallel nozzle to be substantially in parallel with the side walls of the casing of each unit, the equalizing plate having a heater supporting structure arranged therein at locations in alignment with the openings formed in the side walls.

3. A fan according to claim 1, further comprising a heater energizing circuit which is fed with a three-phase alternating current supply, each of the two rows of parallel nozzle array which are formed by coupling the units has two heater arranged therein, and the heater energizing circuit energizes the four heaters.

4. A fan according to claim 3, wherein the heaters are bar-like sheathe heaters which extend in each nozzle array therealong, and the heaters in each nozzle array are arranged one above the other.

5. A fan according to claim 3, wherein the heaters are bar-like sheathe heaters which extend in each nozzle array therealong, and the heaters in each nozzle array are arranged side by side.

6. A fan comprising:

plural blowing units, each including a relatively hollow casing, an electric motor mounted in the casing and an axial impeller coupled to the motor for generating an air flow from an inlet toward one or more output nozzles;

the casing having one end opened to form the inlet and the opposite end opened to form the output nozzles; and a guide partially defining the outlet nozzles, said guide being a planar heating element which projects into the casing to arrange the nozzles in a parallel pattern, in a slit shape and in rows;

the plural blowing units being coupled together at adjacent sides thereof and arranged in a row, each nozzle having a heating element provided therein so that the heating element contacts air flow passing through the nozzle.

7. A fan comprising:

plural blowing units, each including a relatively hollow casing, an electric motor mounted in the casing and an axial impeller coupled to the motor for generating an air flow from an inlet toward one or more output nozzles;

the casing having one end opened to form the inlet and the opposite end opened to form the output nozzles; and a guide which projects into the casing to arrange the nozzles in a parallel pattern, in a slit shape and in rows;

the plural blowing units being coupled together at adjacent sides thereof and arranged in a row, each nozzle having a heater arranged in each nozzle array so that the heating element contacts air flow passing through the nozzle, the heater having a function to change a discharging direction of the passing air flow to act as a louver.

8. An air curtain device comprising:

plural fan modules, each said fan module including, an electric motor, an impeller driven by said electric motor, a housing containing said motor and impeller directing airflow from an inlet to an outlet, and an airflow director conformally shaped to the outlet of said fan module;

said plural fan modules being assembled together to form said air curtain device;

each said airflow director including first and second opposed pairs of sidewalls generally extending between the input and output thereof, said first pair of opposed sidewalls adjoining on at least one side thereof a corresponding first side of the adjoining airflow director;

each one of said first opposed pair of sidewalls of each airflow director being provided with a heating element receiving aperture located upstream of said outlet, said airflow directors being assembled side by side so that said heating element receiving apertures of said airflow directors are aligned;

said air curtain device further comprising a heating element extending through the heating element receiving apertures of said airflow directors.

9. The air curtain device of claim 8 wherein said first opposed pair of sidewalls of each said airflow director is provided with four heating element receiving apertures;

said air curtain device being provided with four heating elements extending through all of said airflow directors.

10. The air curtain device of claim 9 wherein said device is powered by a three phase power supply, each of said electric motors of said plural fan modules being connected to one of said three phases so that all three phases of said three phase power supply drive approximately the same number of said electric motors;

two of said four heating elements being supplied power from a different one of said three phases, the other two of said four heating elements being collectively supplied from the remaining one of said three phases.

11. An air curtain device comprising:

plural fans, each said fan including, an electric motor, and an impeller driven by said electric motor; and a housing receiving said plural fans to direct airflow from an inlet to an outlet;

an airflow director provided in the housing and directing the airflow from said plural fans; and at least one heater provided within a passage for the airflow defined by said airflow director to heat the air flowing thereby.

12. The air curtain device of claim 11 wherein said airflow director is also said heater.

13. The air curtain device of claim 12 wherein said airflow director is a planar heating element.

14. The air curtain device of claim 12 wherein said airflow director is a sheath heater having a louver shape and function.

15. The air curtain device of claim 14 wherein said airflow director is movable to change the direction of the airflow directed thereby.

* * * * *